US006142411A

United States Patent [19]

Cobleigh

[11] Patent Number: 6,142,411

[45] **Date of Patent: *Nov. 7, 2000**

[54] GEOGRAPHICALLY LIMITED MISSILE

[76] Inventor: Nelson E. Cobleigh, 5565 E. Paseo Cimarron, Tucson, Ariz. 85715

[ * ] Notice: This patent issued on a continued prosecution application filed under 37 CFR 1.53(d), and is subject to the twenty year patent term provisions of 35 U.S.C. 154(a)(2).

[21] Appl. No.: 08/883,637

[22] Filed: Jun. 26, 1997

[51] Int. Cl.[7] ..... F41G 7/28

[52] U.S. Cl. ..... 244/3.14; 342/357; 244/3.15

[58] Field of Search ..... 244/3.14, 3.11, 244/3.15, 3.2; 102/215, 206, 211, 214

[56] References Cited

U.S. PATENT DOCUMENTS

| | | | |
|---|---|---|---|
| 3,949,954 | 4/1976 | Lipsey | 244/3.15 |
| 4,315,609 | 2/1982 | McLean et al. | 244/3.14 |
| 4,420,129 | 12/1983 | Stetter | 244/3.15 |
| 4,934,269 | 6/1990 | Powell | 102/215 |
| 4,972,775 | 11/1990 | Hoyt et al. | 102/215 |
| 5,067,674 | 11/1991 | Heyche et al. | 244/3.14 |
| 5,131,602 | 7/1992 | Linick | 244/3.14 |
| 5,260,709 | 11/1993 | Nowakowski | 244/3.2 |
| 5,344,105 | 9/1994 | Youhanaie | 244/3.14 |
| 5,433,111 | 7/1995 | Hershey et al. | 73/593 |
| 5,522,567 | 6/1996 | Kinstler | 244/3.15 |
| 5,579,013 | 11/1996 | Hershey et al. | 342/357 |
| 5,689,420 | 11/1997 | Brewster . | |
| 5,696,347 | 12/1997 | Sebeny, Jr. et al. | 244/3.15 |

FOREIGN PATENT DOCUMENTS

| | | |
|---|---|---|
| 0 583 972 | 2/1994 | European Pat. Off. . |
| 2 211 371 | 6/1989 | United Kingdom . |

*Primary Examiner*—Charles T. Jordan
*Assistant Examiner*—Denise Buckley
*Attorney, Agent, or Firm*—David W. Collins; Andrew J. Rudd; Glenn H. Lenzen, Jr.

[57] ABSTRACT

A self destruct mechanism for an airborne projectile is provided. The projectile includes a navigation system which provides an absolute global position of the projectile. The position is compared with positions stored in memory. If the position of the projectile is determined to be acceptable, operation of the projectile continues. If the position of the projectile is unacceptable, an electronic control system initiates a self-destruct signal for the projectile.

14 Claims, 2 Drawing Sheets

| | LONG 1 | LONG 2 | LONG 3 | • • • | LONG N | |
|---|---|---|---|---|---|---|
| LAT 1 | A | A | U | | U | $alt_1$ |
| LAT 2 | A | A | A | | U | $alt_2$ |
| LAT 3 | A | U | U | | U | $alt_3$ |
| ⋮ | A | A | U | | U | ⋮ |
| LAT N | U | U | U | | U | $alt_N$ |

30

GEOGRAPHICALLY LIMITED MISSILE

STATEMENT OF GOVERNMENT SUPPORT

This invention was made with government support under Grant No. F08626-93-C0044 awarded by the Department of Defense. The government has certain rights in this invention.

TECHNICAL DESCRIPTION

This invention relates generally to airborne projectiles having navigation capabilities and, more particularly, to airborne projectiles having radio based navigation systems to provide position data and a self-destruct feature which causes the projectile to self-destruct when the missile enters undesirable airspaces.

BACKGROUND OF THE INVENTION

There are several missile systems having various applications for strategic and defense purposes. Such systems include air-to-air, air-to-ground, ground-to-air, and ground-to-ground missiles. A typical missile may have any one of a number of targeting systems known to those skilled in the art. For example, ground-to-ground missiles, such as cruise missiles, one type of which is the Tomahawk Missile, includes a Digital Scene Mapping Area Correlation (DSMAC) guidance system which uses a mapping of the terrain in order to guide the missile to a predetermined geographic area. When the cruise missile reaches the predetermined area, a target is selected and the missile homes in upon the target. Another example of a guided missile is an air-to-air missile. For example, an Advanced Medium Range Air-to-Air Missile (AMRAAM) uses radar to lock in on distant objects to which the missile is guided. Some surface-to-air missiles also use radar guidance systems to lock on to airborne targets. Further yet, some air-to-ground missiles use radar or laser based guidance systems to home in upon a target illuminated by a laser signal.

With the constant improvements in weaponry, the range of several of the missiles discussed above is rather substantial. When a missile has a substantial range, the missile can sometimes wander into friendly or neutral airspace and detonate. Current missile guidance systems do not presently enable the missile to determine its absolute position to prevent it from wandering into unwanted air spaces. A missile wandering into undesired airspace could potentially cause unwanted damage. Thus, there exists a need to implement a self-destruct feature in a missile which operates in accordance with the absolute, global position of the missile.

Thus, it is the object of the present invention to provide a missile which can determine its absolute, global position.

It is a further object of the present invention to provide a missile which determines its absolute, global position and determines if the absolute, global position is within acceptable or unacceptable airspace.

It is yet a further object of the present invention to provide a missile having a self-destruct feature which causes the missile to self-destruct when the missile enters unacceptable air space.

SUMMARY OF THE INVENTION

This invention is directed to a self-destruct apparatus for an airborne projectile. The apparatus includes a navigational system which determines the position of the projectile. The apparatus also includes memory for storing a plurality of positions. Some of the plurality of positions are designated as acceptable positions for the projectile, and others of the positions defined as unacceptable positions for the projectile. An electronic control unit searches for a location in memory which corresponds to the position determined by the navigation system to determine if the position of the projectile is acceptable or unacceptable. The electronic control unit initiates a self-destruct signal which causes the projectile to self-destruct if the position of the projectile is unacceptable.

Additional objects, features and advantages of the present invention will become apparent from the following description and the appended claims, taken in connection with the accompanying drawings.

BRIEF DESCRIPTION OF THE DRAWINGS

In the drawings, which form an integral part of the specification, and are to be read in conjunction therewith, like reference numerals are employed to designate identical components in the various views.

DETAILED DESCRIPTION OF THE INVENTION

Figures 1, 2:
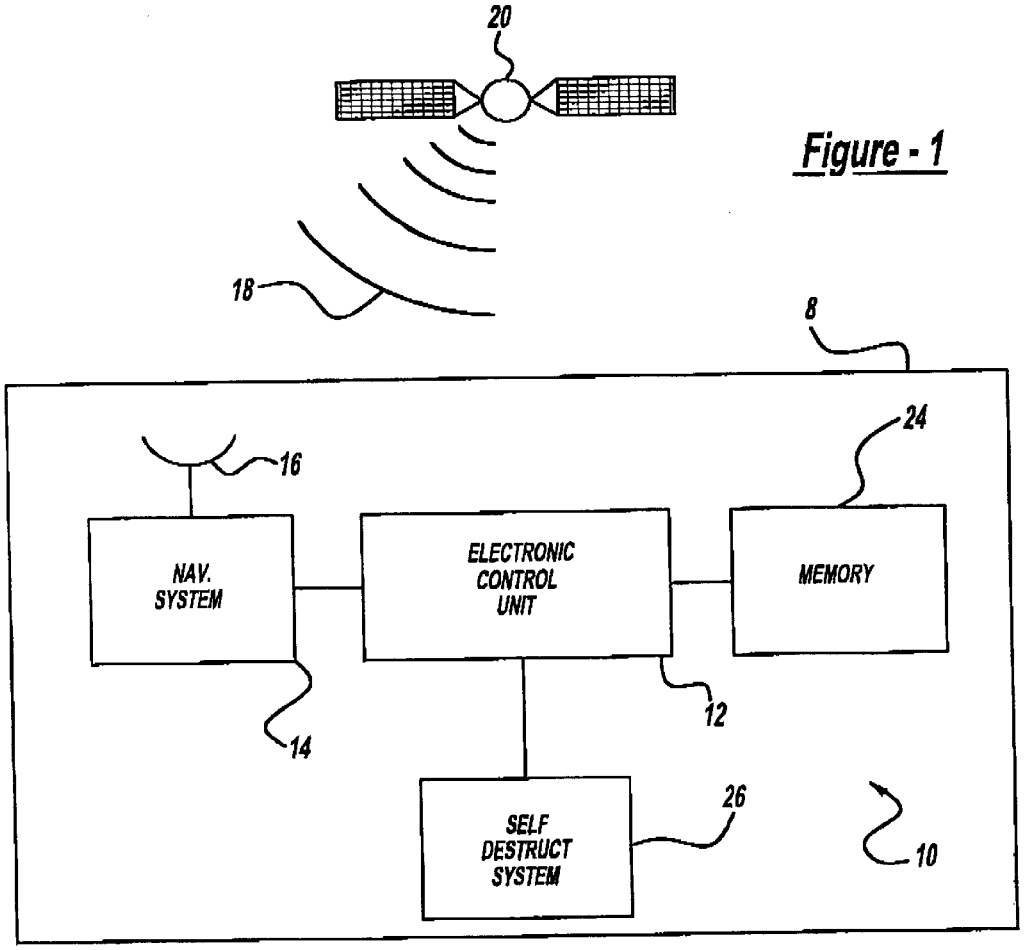
FIG. 1 is a block diagram of a self-destruct mechanism for a missile arranged in accordance with the present invention.
FIG. 2 is an exemplary table which may be stored in memory to determine acceptable and unacceptable positions of the projectile.

FIG. 1 is a block diagram of an electronic control system 10 for a projectile 8. The electronic control system 10 includes an electronic control unit 12. The electronic control unit 12 receives navigational information from a navigation system 14. The navigation system 14 includes an antenna 16. The antenna 16 receives electromagnetic signals 18 radiated by an electromagnetic transmitter, such as satellite 20. An example of such a satellite 20 may be found with reference to one or a plurality of satellites 20 such as are found in a Global Positioning System (GPS), any ground-based electromagnetic transmitters such as may be found in a LOng RANge (LORAN) navigation system, or any other system known to those skilled in the art. The antenna 16 provides electronic input signals to the navigation system 14 in accordance with the received electromagnetic signals 18. Alternatively, the navigation system 14 may be an inertial type navigation system.

The navigation system 14 determines the position of the projectile 8. For example, the navigation system 14 may determine the position of the projectile 8 by determining the latitude and longitude in accordance with the electromagnetic signals 18 received from the one or a plurality of satellites 20. The navigation system 14 may also determine speed and bearing information of the projectile 8 as well. The navigation system 14 outputs this information to the electronic control unit 12. The electronic control unit also communicates with a memory 24. The memory 24 typically stores a table of acceptable and unacceptable latitude and longitude coordinates. The latitude and longitude coordinates provide indices to the table locations. The memory locations corresponding to the latitude and longitude indices define acceptable and unacceptable positions of the projectile 8.

The electronic control unit 12 reads the memory location in accordance with the latitude and longitude coordinates provided by navigation system 14. If the coordinate position of the projectile 8 is acceptable in accordance with the table stored in memory 24, the electronic control unit 12 continues to provide guidance information to control the flight path of the projectile 10. If the memory location 24 indicated by the latitude coordinate location output by navigation system 14 is unacceptable as determined by the table stored in memory 24, the electronic control unit provides a signal to a self-destruct system 26.

FIG. 2 shows an exemplary table 30 which may be stored in the memory 24. The inputs to the table can be found along the upper row and left column of the table. Each row defines a coordinate latitude, and each column defines a coordinate longitude. Within the table, an A indicates an acceptable position for the projectile 8, and a U indicates an unacceptable position for the projectile 8. Each latitude and longitude coordinate position preferably defines boundary points of acceptable and unacceptable positions. The latitude and longitude coordinates output by the navigation system 14 are then matched to the latitudes and longitudes found in table 30 by associating each latitude and longitude coordinate position output by navigation system 14 with the nearest latitude and longitude found in the table 30. In this manner, entire areas can be designated as acceptable or unacceptable positions for the projectile 8. Further, the right column of table 30 also could be used to determine altitude, if desired. In this matter, three inputs, latitude, longitude, and altitude cooperate to determine acceptable and unacceptable positions of the projectile 8.

Figure 3:
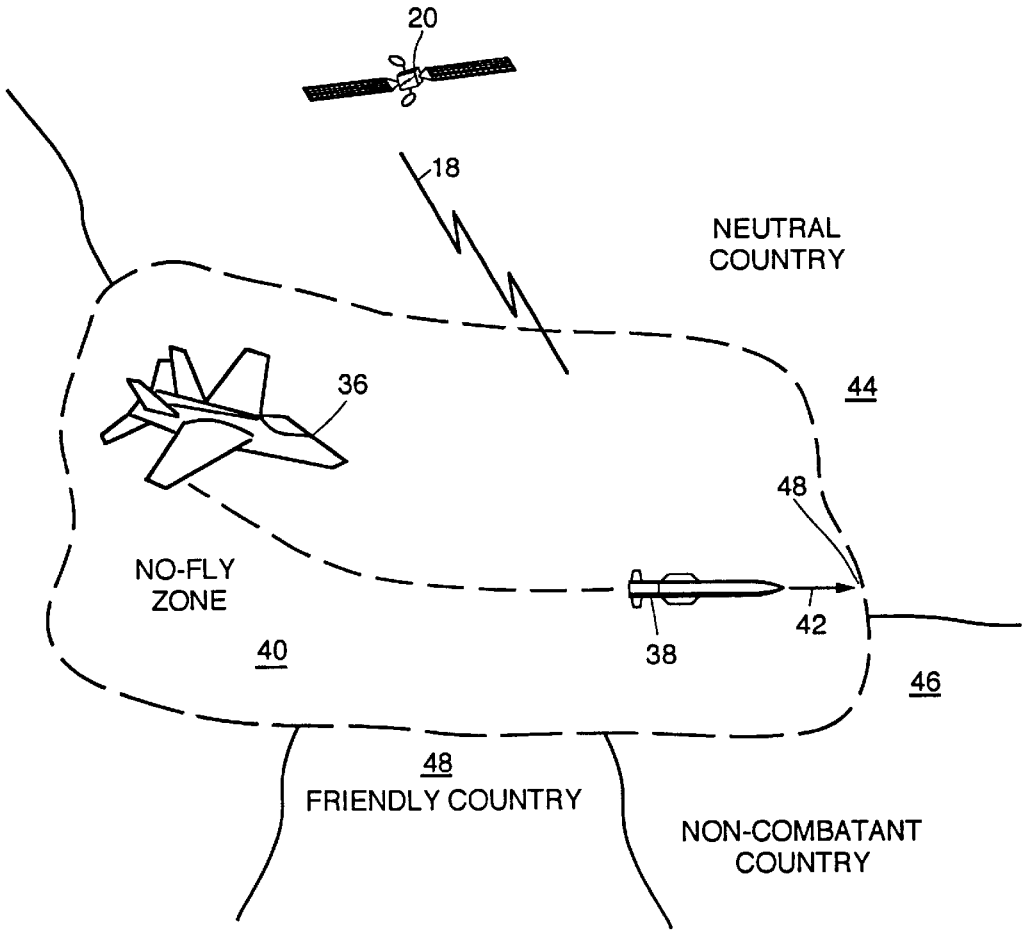
FIG. 3 is a plan view of an airborne missile having implemented therein the invention of FIG. 1.

FIG. 3 depicts a plan view of operation of the electronic control system 10 to operate the self-destruct system 26. In FIG. 3, a plane 36 launches a missile 38 in a geographical boundary defined as a no-fly zone 40. The missile 38 receives electromagnetic signals 18 from satellite 20. As described with respect to FIG. 1, these signals provide navigational information to determine the coordinate position of the missile 38. The path of the missile 38 is indicated by arrow 42. If the missile 38 goes beyond the boundary of no-fly zone 40, indicated in phantom, the missile 38 may enter the territory of a neutral country 44 or a non-combatant country 46. In order to prevent the missile 38 from entering either of these countries, table 30 of FIG. 2 is arranged so that the missile 38 self-destructs when it reaches the boundary of the no-fly zone 42. This prevents the missile 38 from entering the airspace of the neutral country 44, the non-combatant country 46, or the friendly country 48 and greatly improves the safety and operation of the missile 38.

From the foregoing, it can be seen that the present invention enables the safe use of projectile 8, such as rockets or missiles, by including navigational instrumentation in the electronic control portion of the projectile 8. The electronic control portion thus determines if the projectile 8 is located in an acceptable position as determined by latitude, longitude, and/or altitude. If the rocket is in an unacceptable coordinate location, the rocket self-destructs in order to prevent the missile from striking inadvertent targets.

Although the invention has been described with particular reference to certain preferred embodiments thereof, variations and modifications can be effected within the spirit and scope of the following claims.

What is claimed is:

1. An airborne projectile apparatus, comprising:

a navigational system which determines a position of the projectile, the navigation system providing at least one of latitude coordinate information and longitude coordinate information;

memory for storing a plurality of positions, some of the plurality of positions designated as acceptable positions for the projectile and others of the positions defined as unacceptable positions for the projectile; and an electronic control unit which searches for a location in the memory which corresponds to the position determined by the navigation system to determine if the position of the projectile is acceptable or unacceptable, the electronic control unit initiating a self-destruct signal causing the projectile to self-destruct if the position of the projectile is unacceptable.

2. The apparatus of claim 1 wherein the navigation system includes a Global Positioning System (GPS) receiver.

3. The apparatus of claim 1 wherein the navigation system additionally provides altitude information of the projectile.

4. The apparatus of claim 3 wherein the navigation system provides at least one of speed and direction information of the projectile.

5. The apparatus of claim 1 wherein the navigation system provides the position of the projectile, based on electromagnetic signals received from an electromagnetic transmitter.

6. The apparatus of claim 1 wherein the navigational system includes an inertial navigation system.

7. The apparatus of claim 1 wherein the positions stored in memory include at least one of latitude coordinate information, longitude coordinate information, and altitude information.

8. A self-destruct apparatus for an airborne projectile comprising:

a navigational system which determines a position of the projectile in accordance with both latitude coordinate information and longitude coordinate information;

memory for storing a plurality of positions, some of the plurality of positions designated as acceptable positions for the projectile and others of the positions defined as unacceptable positions for the projectile; and an electronic control unit which searches for a location in the memory which corresponds to the position determined by the navigation system to determine if the position of the projectile is acceptable or unacceptable, the electronic control unit initiating a self-destruct signal causing the projectile to self-destruct if the position of the projectile is unacceptable.

9. The apparatus of claim 8 wherein the navigation system includes a Global Positioning System (GPS) receiver.

10. The apparatus of claim 13 wherein the navigation system provides at least one of speed and direction information of the projectile.

11. The apparatus of claim 8 wherein the navigation system provides the position of the projectile, based on electromagnetic signals received from an electromagnetic transmitter.

12. The apparatus of claim 8 wherein the positions stored in memory include at least one of latitude coordinate information, longitude coordinate information, and altitude information.

13. The apparatus of claim 8 wherein the navigation system additionally provides altitude information of the projectile.

14. An airborne projectile apparatus, comprising:

a navigational system which determines a position of the projectile, the navigation system providing at least one of latitude coordinate information and longitude coordinate information;

memory for storing a plurality of positions; and an electronic control unit which searches for a location in the memory which corresponds to the position determined by the navigation system to determine if the position of the projectile is acceptable or unacceptable, the electronic control unit initiating a self-destruct signal causing the projectile to self-destruct if the position of the projectile is unacceptable.

* * * * *